US006523226B2

(12) United States Patent
Graf

(10) Patent No.: US 6,523,226 B2
(45) Date of Patent: Feb. 25, 2003

(54) SAWTOOTH WIRE

(75) Inventor: Ralph A. Graf, Freienbach (CH)

(73) Assignee: Graf + Cie AG, Rapperswil (CH)

( * ) Notice: Subject to any disclaimer, the term of this patent is extended or adjusted under 35 U.S.C. 154(b) by 0 days.

(21) Appl. No.: 09/808,738

(22) Filed: Mar. 15, 2001

(65) Prior Publication Data

US 2001/0037541 A1 Nov. 8, 2001

(30) Foreign Application Priority Data

Mar. 15, 2000 (DE) ..... 100 12 561

(51) Int. Cl.[7] ..... D01G 15/84
(52) U.S. Cl. ..... 19/114; 140/97
(58) Field of Search ..... 19/114, 98, 99, 19/102, 103, 104, 105, 110, 111, 112, 113, 115 R; 29/34 D, 34 R; 76/101.1, 112; 83/846; 140/97; 57/408

(56) References Cited

U.S. PATENT DOCUMENTS 4,653,152 A 3/1987 Wada
4,854,012 A * 8/1989 Graf ..... 19/114
4,964,195 A * 10/1990 Hollingsworth ..... 19/114
5,428,949 A * 7/1995 Stahlecker ..... 19/114
5,555,714 A * 9/1996 Mladek et al. ..... 19/112
5,581,848 A 12/1996 Egerer
6,408,487 B1 * 6/2002 Atkinson ..... 19/114

FOREIGN PATENT DOCUMENTS

DE 4240026 6/1994

* cited by examiner

*Primary Examiner*—Gary L Welch
(74) *Attorney, Agent, or Firm*—Friedrich Kueffner

(57) ABSTRACT

A sawtooth wire for producing an all-steel sawtooth arrangement for processing textile fibers has a wire body having a plurality of teeth arranged successively in the longitudinal direction of the wire body. Each tooth has a tooth bottom and a tooth tip, wherein a tooth breast extends from the tooth bottom toward the tooth tip and a tooth back starts at the tooth tip and extends toward a successive tooth bottom of the successive tooth. The tooth back of at least one of the teeth has one or more convex portions passing over into a concave portion, respectively, in a direction toward the tooth bottom.

13 Claims, 2 Drawing Sheets

SAWTOOTH WIRE

BACKGROUND OF THE INVENTION

1. Field of the Invention

The invention relates to a sawtooth wire for producing an all-steel sawtooth arrangement for processing textile fibers, in particular, for producing an all-steel sawtooth arrangement for a stripper of a carding machine with a plurality of teeth arranged successively in the longitudinal direction of the wire, wherein each tooth has a tooth breast beginning at the tooth bottom and extending in the direction toward the tooth tip and a tooth back extending from the tooth tip in the direction of the successively arranged tooth bottom.

2. Description of the Related Art

A carding machine is used in the production of yarns for the purpose of aligning and cleaning the textile fibers for forming the yarns. For this purpose, the textile fibers are supplied by means of a supply roller, a so-called swift. This is a roller-shaped element which is provided on its mantle surface with a hook arrangement or all-steel sawtooth arrangement and is rotated about the roller axis. The swift arrangement effects together with the card flat rods, distributed about the mantle surface of the swift, aligning and cleaning of the supplied textile fibers. After this process the fiber fleece obtained therewith is then supplied by means of a so-called stripper roller from the swift and transported to further processing stations. Conventionally, the stripper rollers are provided in the area of their mantle surface also with an all-steel sawtooth arrangement which, in the course of rotation of the stripper roller, engages the fiber fleece which is entrained by the swift and removes it from the swift.

Particularly in the processing of especially fine-denier fibers of natural or synthetic polymers it has been found that the transfer of the fiber fleece from the swift to the stripper roller presents problems. This results in a filling of the swift arrangement with fiber material that has not been removed and causes an unsatisfactory alignment and cleaning of the supplied textile fibers by the swift.

Moreover, it was found that the fiber fleece entrained by the stripper roller, particularly in the case of higher production weights, is prematurely removed from the stripper roller, and this can result in problems during further processing of the fiber material.

For eliminating these problems it has already been suggested to provide the sawteeth of the all-steel sawtooth arrangement of the stripper rollers with lateral rolled groove arrangements. This can be realized, for example, by a cold forming process during the course of the wire production wherein the sawteeth are stamped out of blade portions of the wire already provided with rolled groove arrangements. By means of these rolled groove arrangements a greater adhesion especially of fine-denier fibers of natural and synthetic polymers is achieved on the tooth flank. Accordingly, the transfer of the fiber fleece from the swift onto the stripper roller is positively affected in the sense that the transfer is quicker and the otherwise possible filling of the swift arrangement is prevented. Moreover, it was found that these lateral rolled groove arrangements, as a result of the increased greater adhesion of the fibers on the tooth flank, inhibit the premature detachment of the fiber fleece from the stripper roller.

It was however demonstrated that, in particular, for high output carding machines with production output of 80 kg or more in connection with the thus achieved high circumferential speeds of the stripper, despite the increased adhesive force as a result of the rolled groove arrangement in the tooth flanks, a premature detachment of the fiber fleece from the stripper occurs.

SUMMARY OF THE INVENTION

It is an object of the present invention to provide a sawtooth wire which makes possible the production of an all-steel sawtooth arrangement for the stripper of a carding machine and with which a premature detachment of the fiber fleece can be reliably prevented.

In accordance with the present invention, this is achieved in that the tooth back of at least one tooth of the sawtooth wire has at least one convex portion having a transition into a convex portion in the direction toward the tooth bottom.

In this context, the expression "concave portion" refers to a portion of the tooth back whose successively arranged points are connected to one another only by straight lines positioned external to the sawteeth, while the expression convex portion refers to such edge courses whose successively arranged points are connected to one another by straight lines extending within the tooth flanks.

With the sawtooth wires according to the invention, an abutment for the fibers engaged by the stripper is provided by means of the transition of the convex portion into the concave portion in the area of the tooth back, and with the aid of the abutment a premature detachment of the fibers can be reliably prevented so that even for high production speeds a disturbance-free operation of the carding machine is made possible.

Even though it is also conceivable to provide this abutment by a depression in the course of the tooth back, wherein a concave portion is arranged between two convex portions of the tooth back, it has been found to be particularly beneficial when this abutment is provided by a projection or a cam in the area of the tooth back in which the convex portion forming a crown of the projection or the cam is arranged between two concave portions.

An especially high retaining force can be achieved when the tooth back of at least one of the teeth is provided with a plurality of convex portions each having a transition into a concave portion for obtaining a number of successively arranged depressions and/or projections or cams over the extension of the tooth back.

With respect to the fact that the all-steel sawtooth arrangement of the stripper engages usually in the area of individual tooth tips into the fiber fleece entrained by the swift, it was found to be especially favorable for obtaining a sufficient retaining force when at least one of the convex portions is arranged in the upper half of the tooth back adjoining the tooth tip, preferably in the upper third, particularly preferred in the upper fourth, of the tooth back.

Even though the concave portion as well as the convex portion can be provided in the form of progressions of straight-extending edge portions, it was found to be particularly beneficial with respect to obtaining a satisfactory retaining force, while simultaneously ensuring a gentle engagement of the fiber fleece, when the concave portion and/or the convex portion has a curved extension with a radius of curvature in the range of 0.05 to 0.4 mm, preferably 0.1 mm to 0.3 mm, particularly preferred approximately 0.2 mm.

In the context of the invention, it has also been considered to provide only individual sawteeth, for example, only every other, third or randomly selected sawtooth with a tooth back according to the invention. However, it has been found to be particularly beneficial when each tooth of the sawtooth wire has at least one convex portion having a transition into a concave portion in the direction toward the tooth bottom.

In sawtooth wires according to the invention an especially pronounced tooth tip of the individual sawteeth can be ensured when in at least one of the teeth the tooth breast has a concave breast portion forming a transition into the tooth tip and the tooth back has a convex portion adjacent to the tooth tip. With sawteeth formed in this way an especially reliable removal of the fiber fleece from the swift takes place.

Even though the tooth shape according to the invention already provides an especially high retaining force, in some cases, in particular, in the case of high output carding, it is required to provide an increase of this retaining force. In these cases, the embodiment of the sawteeth according to the invention can be combined with the known provision of rolled groove arrangements in the area of the tooth flanks so that at least one tooth flank, extending approximately parallel to the longitudinal direction of the wire, of at least one of the teeth has at least one profiling. This profiling can be at least one profiled groove extending approximately in the longitudinal direction of the wire and/or at least one profiled stay extending approximately in the longitudinal direction of the wire.

As has been explained in the beginning, sawteeth for processing textile fibers can be produced in that the starting material is shaped to a wire having blade portions and, subsequently, sawteeth are stamped into the blade portion. For producing sawtooth wires according to the invention, a tooth back can be produced on at least one of the sawteeth by the stamping process so as to have at least one convex portion having a transition into a concave portion in the direction toward the tooth ground. In addition, at least one flank of the blade portion, when forming the starting material, for example, by cold forming, can be provided with a profiling, like, for example, at least one groove extending parallel to the longitudinal direction of the wire and/or at least one stay extending parallel to the longitudinal direction of the wire.

DESCRIPTION OF THE PREFERRED EMBODIMENTS

Figure 1A:
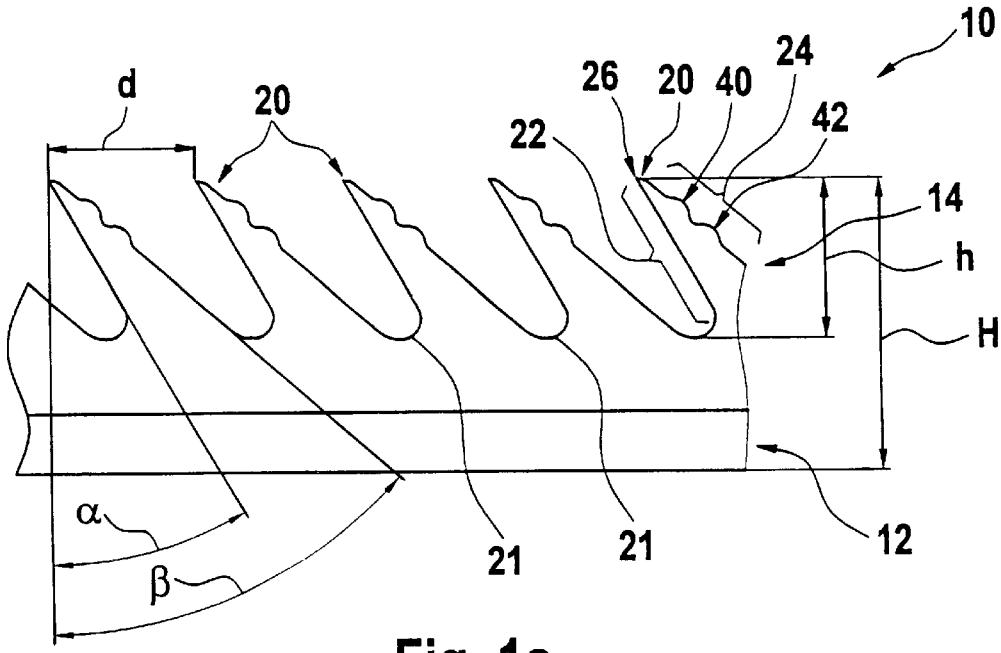
FIG. 1*a* shows a side view of a sawtooth wire according to a first embodiment of the invention.

The sawtooth wire 10 illustrated in FIG. 1*a* comprises a wire body having a foot portion 12 and a blade portion 14 of minimal width. The total height H of the sawtooth wire is 4 mm. In the blade portion 14 a number of teeth 20 are stamped which are arranged successively in the longitudinal direction of the wire. Each of these teeth 20 comprises a tooth breast 22 extending from a tooth bottom 21 to a tooth tip 26 as well as a tooth back 24 extending from the tooth tip 26 down to the following tooth bottom 21. The spacing d between successively arranged teeth is 1.96 mm. The tooth cut depth h is 2.2 mm. The above-used expression tooth bottom refers to the location of the deepest tooth cut between successively arranged teeth 20.

Figure 1B:
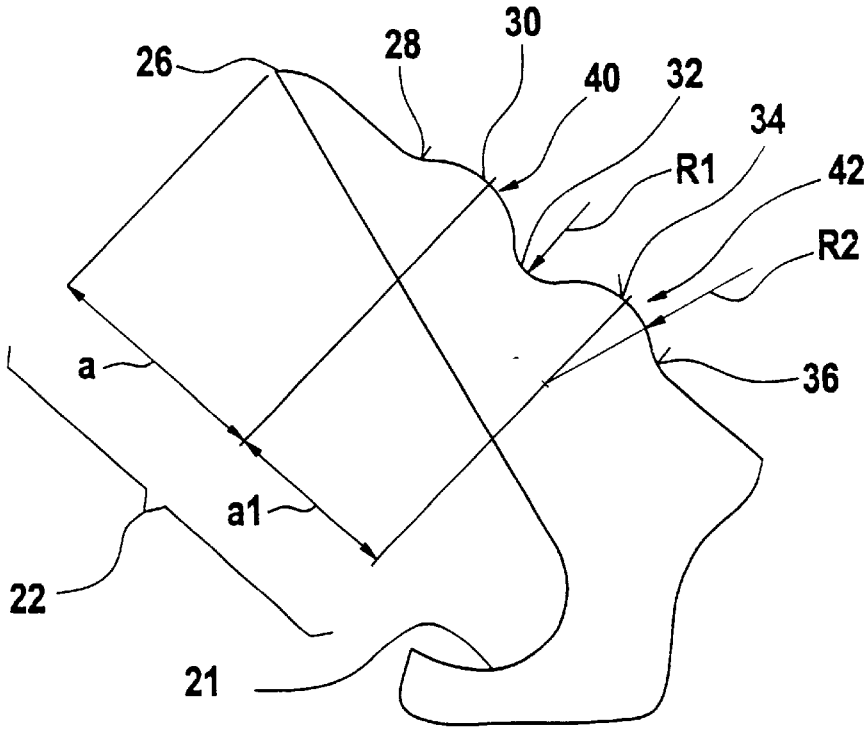
FIG. 1*b* shows a detail illustration of a tooth of the sawtooth wire according to FIG. 1*a;*

In the sawtooth wire 10 illustrated in the drawing, the breast angle $\alpha$ is 30° and the back angle $\beta$ is 48°. As can be seen in FIG. 1*a,* the tooth back 24 of each tooth 20 of the sawtooth wire 10 has two projections or cams 40 and 42 which are arranged at the upper half of the tooth back 24 adjoining the tooth tip 26. The shape of these projections 40 and 42 is illustrated in detail in FIG. 1*b*.

Accordingly, the projection 40 neighboring the tooth tip 26 is delimited by a concave surface area 28, a convex surface area 30, and a further concave surface area 32, wherein the concave surface area 28 has a transition into a convex surface area 30 in the direction toward the tooth bottom 21 which, in turn, has a transition into the concave surface area 32 in the direction toward the tooth bottom so that the convex surface area 30 is arranged between the concave surface areas 28 and 32. In the area of the transition between the convex surface area 30 and the concave surface area 32 the projection 40 provides an abutment for textile fibers entrained by an all-steel arrangement formed of a corresponding sawtooth wire.

The second projection or cam 42 is delimited by a concave surface area 32, a further convex surface area 34, and an additional concave surface area 36, wherein the concave surface area 32 has a transition into the further convex surface area 34 in the direction toward the tooth bottom 21, which, in turn, has a transition into the further concave surface area 36. Here the transition between the convex surface area 34 and the concave surface area 36 provides also an abutment for the fibers entrained by a correspondingly configured all-steel sawtooth arrangement.

The radius of curvature R1, R2 of the convex surface areas 30 and 34 is, like the radius of curvature of the concave surface areas 28, 32, and 36, approximately 0.2 mm. The spacing a of the crown of the first projection 40 from the tooth tip 26 in the embodiment illustrated in the drawing is 0.7 mm while the spacing a1 between the crowns of the projections 40 and 42 is 0.53 mm. It was found that an especially high retaining force can be provided with these dimensions while simultaneously ensuring a gentle engagement in the fiber fleece.

Figure 2A:
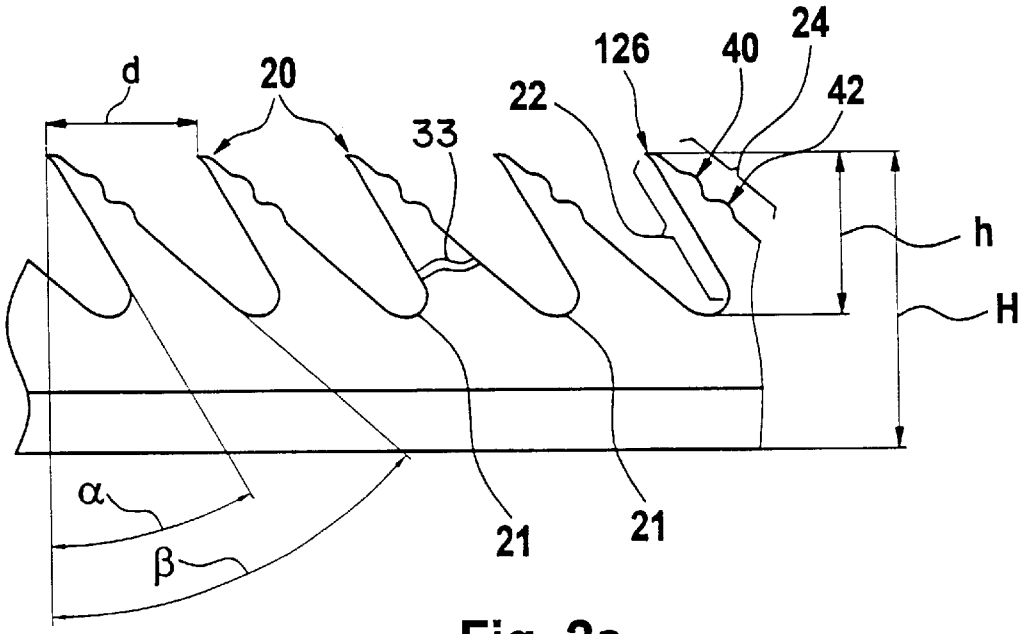
FIG. 2*a* shows a side view of the sawtooth wire according to a second embodiment of the invention.
Figure 2B:
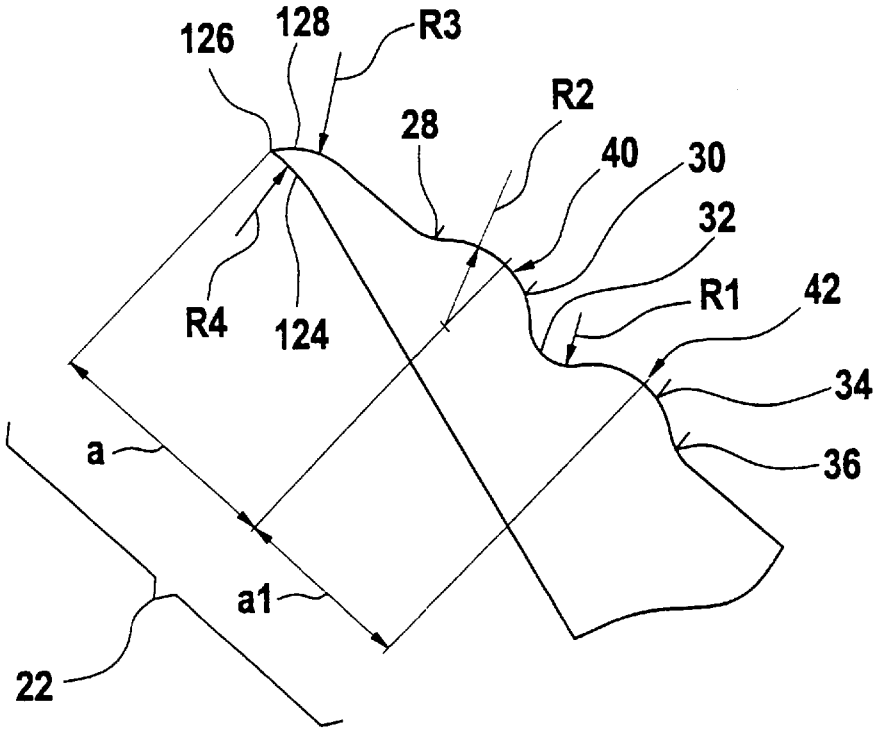
FIG. 2*b* shows a detail illustration of a tooth of the sawtooth wire illustrated in FIG. 2*a*.

The sawtooth wire illustrated in FIG. 2 corresponds substantially to the sawtooth wire explained in connection with FIG. 1. Accordingly, for identifying the individual parts of this sawtooth wire the same reference numerals are used as for the identification of the individual parts of the sawtooth wire represented in FIG. 1. A difference is to be noted only in the area of the tooth tips of the individual sawteeth 20 of this sawtooth wire. In this connection, the tooth tip 126 of the sawtooth wire illustrated in FIG. 2 is more defined in that the tooth breast 22 has a concave portion 124 as a transition into the tooth tip 126 while the tooth back has a convex portion 128 adjoining the tooth tip. The radius of curvature R4 of the concave surface area 124 of the tooth breast 22 in the embodiment of the invention illustrated in the drawing is 1 mm, while the radius of curvature R3 of the convex surface area 128 of the tooth back is 0.5 mm.

In the embodiment of the invention illustrated in the drawing each tooth of the sawtooth wire is provided with two projections or cams in the area of the tooth back. However, in addition, the use of such embodiments in which every other, third or any tooth is provided with corresponding cams is also conceivable. Moreover, an embodiment is also conceivable in which individual or all teeth have only one cam or more than two cams. Otherwise, the tooth flanks of the individual teeth can also be provided with profilings, such as, for example, profiled grooves 33, as schematically shown in FIG. 2*a* or profiled stays in order to increase the fiber retaining force. Also, the invention is not limited to the precise dimensions of a sawtooth wire explained in connection with the drawings. It is instead decisive that at least one of the sawteeth in the area of its tooth back has at least one convex surface area having a transition into a concave surface area and forming an abutment for the fibers to be entrained by the teeth. This abutment cannot only be formed as a projection or cam, as formed in the preferred embodiments of the invention illustrated in the drawing, but also in the form of a depression in the area of the tooth backs.

While specific embodiments of the invention have been shown and described in detail to illustrate the inventive principles, it will be understood that the invention may be embodied otherwise without departing from such principles.

What is claimed is:

1. A sawtooth wire for producing an all-steel sawtooth arrangement for processing textile fibers, the sawtooth wire comprising:

a wire body having a plurality of teeth arranged successively in the longitudinal direction of the wire body;

each of the teeth having a tooth bottom, a tooth tip, a tooth breast extending from the tooth bottom toward the tooth tip and a tooth back starting at the tooth tip and extending toward a successive tooth bottom of the successive tooth;

wherein the tooth back of at least one of the teeth has one or more convex portions passing over into a concave portion, respectively, in a direction toward the tooth bottom, and wherein at least one of the concave portions and the convex portions has a curved course with a radius of curvature of 0.05 to 0.4 mm.

2. The sawtooth wire according to claim 1, wherein the tooth back of at least one of the teeth has at least two concave portions so that at least one of the convex portions is arranged between two of the concave portions.

3. The sawtooth wire according to claim 1, wherein the tooth back of at least one of the teeth has a plurality of convex portions passing over into the concave portions, respectively.

4. The sawtooth wire according to claim 1, wherein at least one of the convex portions is arranged in the upper half of the tooth back adjoining the tooth tip.

5. The sawtooth wire according to claim 4, wherein the at least one of the convex portions is arranged in the upper third of the tooth back.

6. The sawtooth wire according to claim 4, wherein the at least one of the convex portions is arranged in the upper fourth of the tooth back.

7. The sawtooth wire according to claim 1, wherein the radius of curvature is 0.1 to 0.3 mm.

8. The sawtooth wire according to claim 7 wherein the radius of curvature is approximately 0.2 mm.

9. The sawtooth wire according to claim 1, wherein each one of the teeth of the sawtooth wire has one or more of the convex portions passing over into the concave portion in the direction toward the tooth bottom.

10. The sawtooth wire according to claim 1, wherein at least one of the teeth has a concave breast portion via which the tooth breast passes over into the tooth tip and one of convex portions of the tooth back adjoins the tooth tip.

11. The sawtooth wire according to claim 1, wherein at least one of the teeth has at least one tooth flank with a profiling, the at least one tooth flank extending approximately parallel to the longitudinal direction of the wire body.

12. The sawtooth wire according to claim 11, wherein the profiling comprises at least one of one or more profiled grooves extending in the longitudinal direction of the wire body and one or more profiled stays extending in the longitudinal direction of the wire body.

13. The sawtooth wire according to claim 1, for producing an all-steel sawtooth arrangement for a stripper of a carding machine.

* * * * *